US010695901B2

(12) United States Patent
Engebretson

(10) Patent No.: US 10,695,901 B2
(45) Date of Patent: Jun. 30, 2020

(54) RETENTION DEVICE FOR HAND-HELD POWER TOOLS

(71) Applicant: Curt J. Engebretson, Mandan, ND (US)

(72) Inventor: Curt J. Engebretson, Mandan, ND (US)

( * ) Notice: Subject to any disclaimer, the term of this patent is extended or adjusted under 35 U.S.C. 154(b) by 0 days.

(21) Appl. No.: 16/054,121

(22) Filed: Aug. 3, 2018

(65) Prior Publication Data

US 2019/0054610 A1 Feb. 21, 2019

Related U.S. Application Data

(63) Continuation of application No. 15/680,583, filed on Aug. 18, 2017, now Pat. No. 10,065,303.

(51) Int. Cl.
*B25H 3/00* (2006.01)

(52) U.S. Cl.
CPC ..... *B25H 3/006* (2013.01)

(58) Field of Classification Search
None
See application file for complete search history.

(56) References Cited

U.S. PATENT DOCUMENTS 1,766,616 A 6/1930 Faris
2,869,769 A 1/1959 Robinson
4,756,119 A 7/1988 Chabot
4,920,950 A 5/1990 Johnson
5,067,535 A 11/1991 Wolff
5,078,353 A 1/1992 Linn
5,205,422 A * 4/1993 Morris ..... B23D 59/007 211/70.6
5,333,823 A 8/1994 Joseph
5,383,411 A 1/1995 Tomaka et al.
5,685,676 A * 11/1997 Johnson ..... B25H 1/005 144/136.95
5,988,243 A * 11/1999 Ayala ..... B23D 47/025 144/286.5
6,152,417 A 11/2000 Randall
6,170,405 B1 1/2001 Weitzman et al.
6,237,659 B1 5/2001 Francis
6,279,741 B1 8/2001 Arvin
6,568,506 B1 5/2003 Donnalley
6,607,015 B1 8/2003 Chen
6,662,838 B1 12/2003 Graham, III
6,719,250 B2 4/2004 Fitzsimons
6,779,466 B2 8/2004 Shabram
6,786,162 B1 9/2004 Volkmer et al.
7,055,442 B2 6/2006 Podd et al.
7,628,186 B2 12/2009 Blum
(Continued)

*Primary Examiner* — Monica E Millner
(74) *Attorney, Agent, or Firm* — Maier & Maier,PLLC

(57) ABSTRACT

A retention device for hand-held power tools. The retention device may include a first plate which may be attached to the underside of the power tool; a second plate and a third plate which may be connected to the first plate via hinges. The second and third plates may have aligned notches fit for an object such as a piece of lumber. When the second and third plates are extended, the retention device may allow the power tool to be set down on the edge of the object in an upright position. When the second and third plates are folded, the power tool may still be placed in an upright position on a flat surface.

14 Claims, 4 Drawing Sheets

(56) References Cited

U.S. PATENT DOCUMENTS

| | | | | |
|---|---|---|---|---|
| 7,677,283 | B2 * | 3/2010 | Hooker | B25H 1/0021 144/286.5 |
| 7,779,762 | B2 | 8/2010 | Sackman | |
| 8,215,242 | B2 | 7/2012 | Aguayo | |
| 8,376,307 | B2 | 2/2013 | Frolov | |
| 8,382,086 | B2 * | 2/2013 | Bresette | B25H 1/10 269/289 R |
| 8,875,840 | B2 | 11/2014 | Chancler | |
| 10,065,303 | B1 * | 9/2018 | Engebretson | B25H 3/006 |
| 2011/0227271 | A1 * | 9/2011 | Edelmann | B25H 1/10 269/289 R |
| 2014/0374551 | A1 | 12/2014 | Carter | |

* cited by examiner

RETENTION DEVICE FOR HAND-HELD POWER TOOLS

CROSS REFERENCE TO RELATED APPLICANT

This application is a continuation application of U.S. patent application Ser. No. 15/680,583, filed Aug. 18, 2017, and entitled "RETENTION DEVICE FOR HAND-HELD POWER TOOLS", the entire contents of which are hereby incorporated by reference.

BACKGROUND

Nowadays, cordless hand-held power tools tend to be designed to be rested in an upright position on a flat surface, such as a workbench, floor, etc. This can make the tools easy to retrieve and may protect bits or other attachments from damage. However, if the user of a tool needs to stand up or work at a high position while using the power tools, there is a risk of the tool being dropped and damaged because there is generally no suitable place for the tool to be rested.

SUMMARY

Exemplary embodiments described herein generally relate to a retention device for hand-held power tools and, more specifically, to the retention device which helps the hand-held power tool to be set down on an edge of an object in a stable and upright position. The retention device can minimize the risk of the tool being dropped and damaged.

Such a retention device may include: a first plate being adhesively attachable to a hand-held power tool; a second plate connected to the first plate and having a first notch; a third plate connected to the first plate and having a second notch; a first hinge connecting the first plate and the second plate; and a second hinge connecting the first plate and the third plate. According to an exemplary embodiment, the second plate and the third plate are folded via the first hinge and the second hinge for the hand-held power tool to be placed in an upright position on a flat surface. Also, in an exemplary embodiment, the second plate and the third plate are extended via the first hinge and the second hinge for the hand-held power tool to be set down on an object in an upright position, and the first notch and the second notch may fit on an edge of the object.

BRIEF DESCRIPTION OF THE DRAWINGS

Advantages of embodiments of the present invention may be apparent from the following detailed description of the exemplary embodiments. The following detailed description should be considered in conjunction with the accompanying Figures in which:

Exemplary FIG. 1 may show a retention device for hand-held power tools where the side plates are extended;

Figure 2:
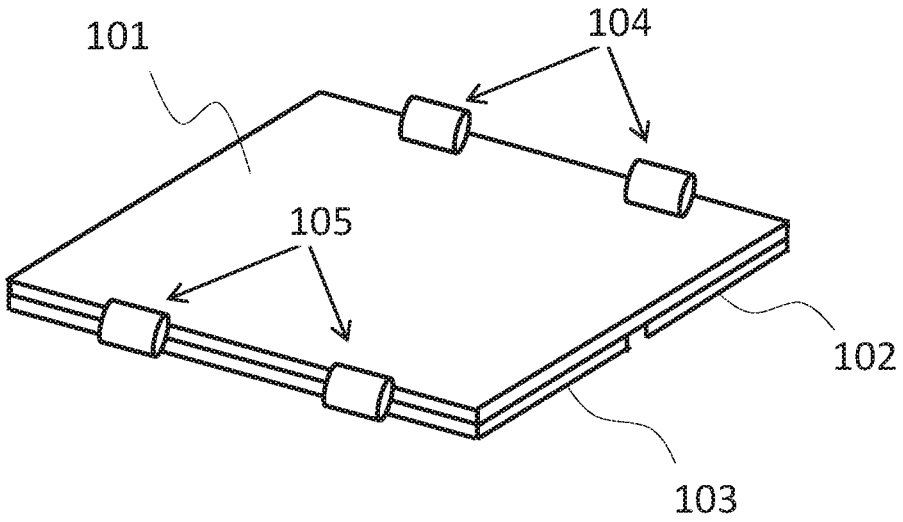
Figure 3:
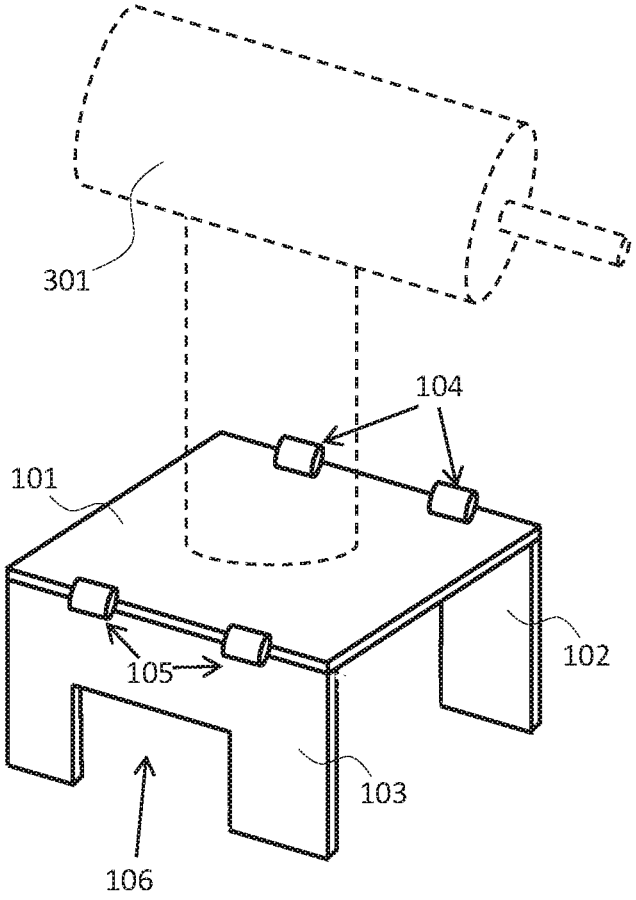
Figure 4:
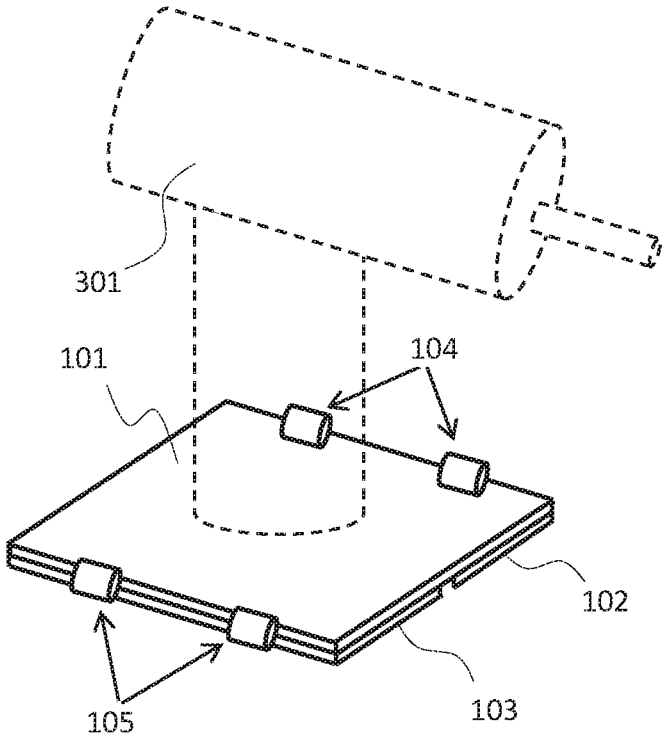
Figure 5:
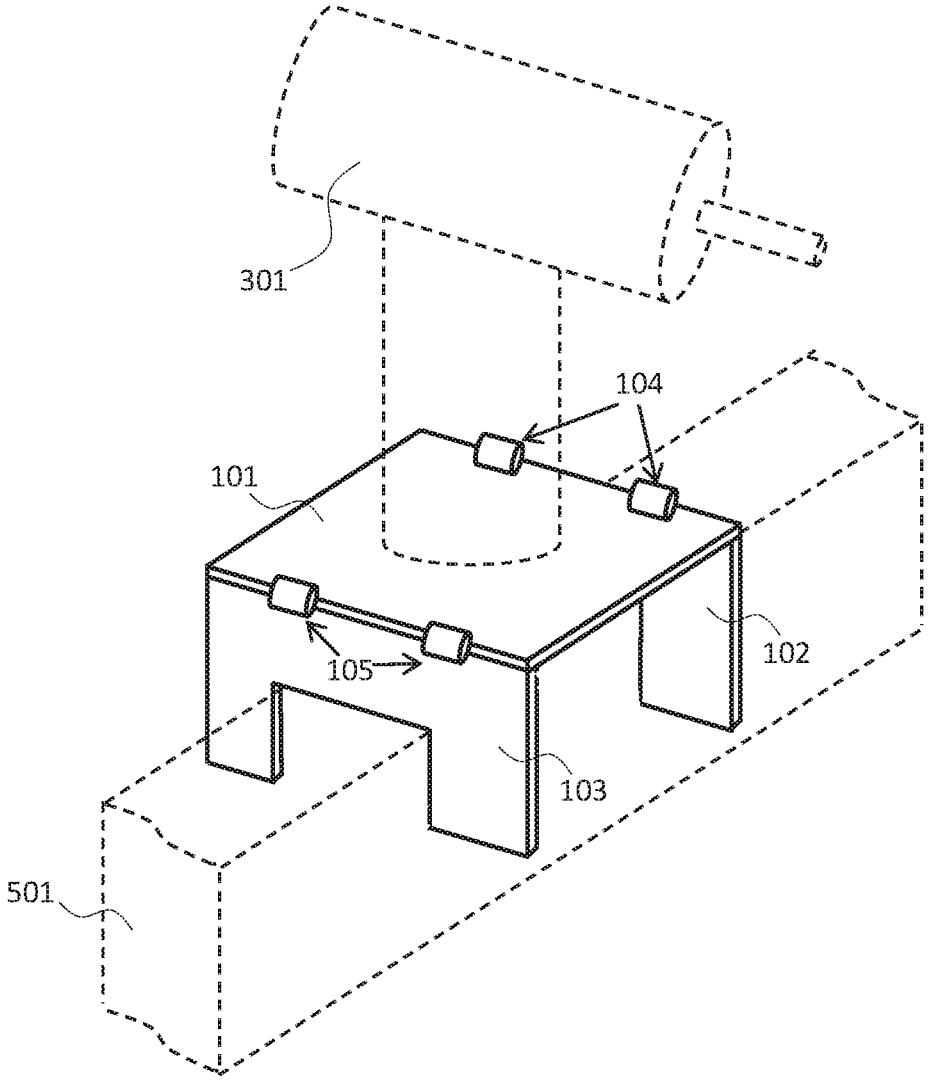

Exemplary FIG. 2 may show the retention device for hand-held power tools where the side plates are folded;

Exemplary FIG. 3 may show the retention device for hand-held power tools where the side plates are extended and an exemplary power tool is attached thereto;

Exemplary FIG. 4 may show the retention device for hand-held power tools where the side plates are folded and an exemplary power tool is attached thereto; and Exemplary FIG. 5 may show the retention device for hand-held power tools with exemplary environment.

DETAILED DESCRIPTION

Aspects of the present invention are disclosed in the following description and related Figures directed to specific embodiments of the invention. Those skilled in the art may recognize that alternate embodiments may be devised without departing from the spirit or the scope of the claims. Additionally, well-known elements of exemplary embodiments of the invention may not be described in detail or may be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Generally referring to the figures and specification, various exemplary embodiments of a retention device for hand-held power tools may be shown and described. Such a retention device is adhesively attachable to the underside of the power tool and permits the tool to be set down on the edge of an object such as a lumber in a stable and upright position. Thus, the retention device minimizes the risk of the tool being dropped and damaged.

Figure 1:
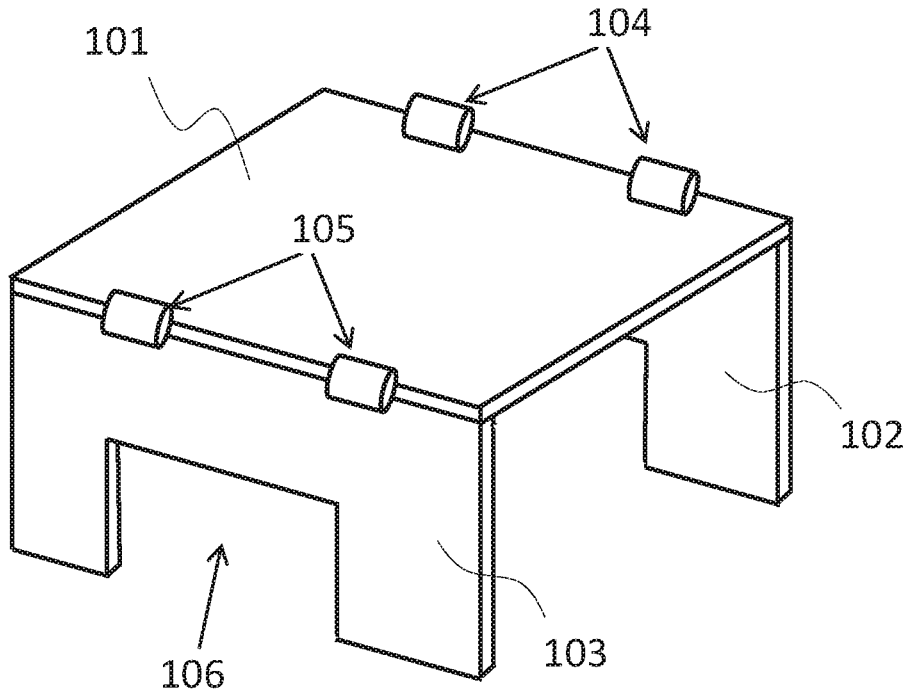

Turning now to exemplary FIG. 1, FIG. 1 shows a retention device for hand-held power tools where the side plates are extended. According to an exemplary embodiment, the retention device may include a first plate 101 which is to be adhesively attached to the hand-held power tool. For example, most power tools have a battery pack at the bottom part, and the first plate 101 may be bonded to the underside of the power tool's battery pack. Also, in an exemplary embodiment, the first plate 101 may be rectangular, for example, approximately 4 inches by approximately 3 inches, and the long edges of the first plate 101 may be pivotally attached to a pair of additional plates, a second plate 102 and a third plate 103. According to an exemplary embodiment, the second plate 102 may be connected to the first plate 101 via a first hinge 104, and the third plate 103 may be connected to the first plate 101 via a second hinge 105. The hinges (104 and 105) may include detents to hold the second and the third plates (102 and 103) in their fully extended and retracted positions. Other locking hinge mechanisms may be used, as would be understood by a person having ordinary skill in the art. In some exemplary embodiments, the hinge may have a release button to release the hinge from a locked orientation. In yet further embodiments, the hinge may be spring loaded, such that plates 102 and 103 may retract from an extended position to a folded position when the release button is pressed.

Referring still to FIG. 1, the second and third plates (102 and 103) may have notches 106 in their centers. According to an exemplary embodiment, the notches 106 may be similarly shaped and may be aligned, forming a track. Also, in an exemplary embodiment, the notches 106 may be sized to be large enough to fit on an edge of an object such as a piece of lumber, and the fit between the notches 106 and the object may be tight enough to support the hand-held power tool attached to the retention device in a stable and upright position on the edge of the object.

Turning now to exemplary FIG. 2, FIG. 2 shows the retention device for hand-held power tools where the side plates are folded. As described above, the second plate 102 may be connected to the first plate 101 via a first hinge 104, and the third plate 103 may be connected to the first plate 101 via a second hinge 105. According to an exemplary embodiment, the second and third plates (102 and 103) may be folded so that the power tool attached on the retention device may still be placed in an upright position on a flat surface in a conventional manner. Also, as mentioned above, by extending the second and third plates (102 and 103), a pair of aligned notches 106 may permit the retention device attached to the tool be set down on the edge of an object.

Turning now to exemplary FIG. 3, FIG. 3 shows the retention device for hand-held power tools where the side plates are extended and the power tool is attached to a top surface of the first plate. As described above, the first plate 101 of the retention device may be adhesively attached to the underside of the hand-held power tool 301 helping the tool 301 to be secured in a stable and an upright position on the edge of an object. Also, in another exemplary embodiment, even when the second and third plates (102 and 103) are extended, the retention device attached to the power tool 301 may still be placed in an upright position on a flat surface as desired.

Turning now to exemplary FIG. 4, FIG. 4 shows the retention device for hand-held power tools where the side plates are folded and the power tool 301 is attached to a top surface of the first plate. As described above, when the second and third plates (102 and 103) of the retention device are folded, the retention device attached to the power tool 301 may be placed in an upright position on a flat surface in a conventional manner.

Turning now to exemplary FIG. 5, FIG. 5 shows the retention device for hand-held power tools resting on the edge of an object, such as a piece of lumber. As described above, when the second and third plates (102 and 103) are extended, the pair of the notches 106 may fit on an edge of the object 501 supporting the hand-held power tool 301 securing the power tool in a stable and an upright position on the edge of the object 501. According to an exemplary embodiment, the object 501 may be a standard piece of inch and a half thick lumber, for example, a two by four, two by six, etc., such as lumber used for a floor joist, ceiling joist, etc, as would be understood by a person having ordinary skill in the art. In this manner, the retention device can permit the hand-held power tool 301 to be set down in a stable position under circumstances where there is no suitable place for the tool 301 to be rested. This may save time and effort, as well as minimize the risk of the tool 301 being dropped and damaged.

According to an exemplary embodiment, the first, second and third plates (101, 102 and 103) may be fabricated using injection-molded nylon, ABS (Acrylonitrile-Butadien-Styrene resin), or other suitable plastics as well as suitable metals strong enough to support the weight of the power tool 301 when resting on the edge of the object 501. Also, in an exemplary embodiment, the first and second hinges (104 and 105) may also be made of suitable plastic as well as metals strong enough to hold the second and third plate (102 and 103) in their fully extended or retracted positions.

The foregoing description and accompanying figures illustrate the principles, preferred embodiments, and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A resting mount for a hand-held power tool comprising:

a first plate configured to be secured to a surface of the power tool and two side plates extending from opposite ends of the first plate in a direction away from the power tool when the surface of the power tool is secured to the first plate, wherein the mount is configured to be placed on an object on which the tool is rested;

wherein each side plate of the two side plates is hinged to the first plate, so as to swing from a position parallel and adjacent to the first plate to a position substantially perpendicular to the first plate;

wherein each side plate of the two side plates comprises a notch cut into a distal end opposite the first plate and shaped to removably receive the object, the notch extending through the entire plane of the side plate; and wherein, when the two side plates are in the position substantially perpendicular to the first plate, the notches of the two side plates are capable of receiving an object having a dimension greater than the space between the two side plates, so as to support the mount on the object.

2. The power tool mount of claim 1, wherein the first plate is detachable from the surface of the power tool.

3. The power tool mount of claim 1, wherein each of the two side plates is configured to swing to a position in line with the first plate.

4. The mount of claim 1, wherein the first plate and the two side plates are one of plastic or metal.

5. The mount of claim 1, wherein the notches in the two side plates form a receiving track for removably securing an object on which the mount rests.

6. The mount of claim 1, wherein the first plate is configured to be secured to a battery pack of the power tool.

7. The mount of claim 1, wherein the first plate is configured to be secured to the power tool by adhesive.

8. The mount of claim 1, wherein the notch is disposed substantially at the center of the distal end of each side plate of the two side plates.

9. The mount of claim 1, wherein, when the two side plates are in the position parallel and adjacent to the first plate, the distal ends of the two side plates are adjacent each other.

10. The mount of claim 1, wherein, when the two side plates are in the position parallel and adjacent to the first plate, the mount can be placed on a flat object.

11. The mount of claim 1, wherein the width of each of the two side plates is less than half of the width of the first plate.

12. The mount of claim 1, wherein the object completely extends through the first passage and the notches.

13. The mount of claim 1, wherein the object is bounded by a top edge of each notch and by two side edges of each notch.

14. The mount of claim 1, wherein, when the two side plates are in the position substantially perpendicular to the first plate, the notches of the two plates are aligned and form a first passage therebetween; and a second passage is formed between the two side plates, the second passage being perpendicular to the first passage.

* * * * *